US012479636B2

(12) United States Patent
Maresse

(10) Patent No.: US 12,479,636 B2
(45) Date of Patent: Nov. 25, 2025

(54) ROTARY CONNECTION INTERFACE FOR A SEALED TRANSFER CONTAINER

(71) Applicant: GETINGE LIFE SCIENCE FRANCE, Vendôme (FR)

(72) Inventor: Aurélien Maresse, Aze (FR)

(73) Assignee: GETINGE LIFE SCIENCE FRANCE, Vendôme (FR)

( * ) Notice: Subject to any disclaimer, the term of this patent is extended or adjusted under 35 U.S.C. 154(b) by 153 days.

(21) Appl. No.: 18/580,218

(22) PCT Filed: Jul. 6, 2022

(86) PCT No.: PCT/FR2022/051359
§ 371 (c)(1),
(2) Date: Jan. 18, 2024

(87) PCT Pub. No.: WO2023/002105
PCT Pub. Date: Jan. 26, 2023

(65) Prior Publication Data

US 2025/0083880 A1 Mar. 13, 2025

(30) Foreign Application Priority Data

Jul. 19, 2021 (FR) ..... 2107750

(51) Int. Cl.
*B65D 55/00* (2006.01)
*B65D 25/20* (2006.01)

(52) U.S. Cl.
CPC ..... *B65D 55/00* (2013.01); *B65D 25/20* (2013.01)

(58) Field of Classification Search
CPC ..... B65D 55/00; B65D 25/20; G21F 7/005
See application file for complete search history.

(56) References Cited

FOREIGN PATENT DOCUMENTS

| | | | |
|---|---|---|---|
| FR | 2695343 | A1 | 3/1994 |
| FR | 2777822 | A1 | 10/1999 |
| FR | 3010120 | A1 | 3/2015 |

(Continued)

OTHER PUBLICATIONS

Anonymous: "Vakuumflansch—Wikipedia", May 21, 2021, XP055904468. Retrieved from the Internet: <URL:htpps://de.wikipedia.org/wiki/Vakuumflansch [retrieved on Mar. 23, 2022].

(Continued)

*Primary Examiner* — Andrew D Perreault
(74) *Attorney, Agent, or Firm* — McDonald Hopkins LLC

(57) ABSTRACT

Connection interface rotating about a longitudinal axis. A first end portion includes outer lugs extending radially towards the outside and which are capable of forming an outer upper bayonet link. a second end portion includes lower notches capable of forming a peripheral lower bayonet link with an outer element. A central passage passes all the way through connecting the first end portion and the second end portion, the central passage including inner lugs capable of forming an inner upper bayonet link. A joint is mounted on the first end portion. The second end portion includes an annular housing including an axial groove opening into an end face of the second end portion, and a radial groove surrounding the axial groove. The radial groove is configured to house lugs of the outer element in order to form the peripheral lower bayonet link and allow a movement of the lugs.

8 Claims, 7 Drawing Sheets

(56) References Cited

FOREIGN PATENT DOCUMENTS

| | | | |
|---|---|---|---|
| FR | 3117464 | A1 | 6/2022 |
| WO | 2016180839 | A1 | 11/2016 |

OTHER PUBLICATIONS

Search Report and Written Opinion for International Application No. PCT/FR2022/051359 dated Dec. 15, 2022.
French Preliminary Search Report for French Patent Application No. 2107750 dated Mar. 24, 2022.
Corresponding French Patent Application No. FR2107750, Preliminary Research Report dated Aug. 2, 2024.

ROTARY CONNECTION INTERFACE FOR A SEALED TRANSFER CONTAINER

CROSS-REFERENCE TO RELATED APPLICATIONS

This is the National Stage application of PCT international application PCT/FR2022/051359, filed on Jul. 6, 2022, which claims the priority of French Patent Application No. 2107750, filed Jul. 19, 2021, both of which are incorporated herein by reference in their entireties.

TECHNICAL FIELD AND PRIOR ART

The present invention relates to a rotary connection interface for a sealed transfer container intended to cooperate with a sealed transfer device mounted on a wall of a chamber.

In a certain number of industrial sectors, among which are the nuclear, medical, pharmaceutical and agri-food sectors, it is necessary or desirable to carry out certain tasks in a confined atmosphere, in order to either protect the environment, for example from radioactivity, from toxicity, etc., or on the contrary be able to carry out these tasks in an atmosphere that is aseptic or devoid of dust, or finally both simultaneously.

The transfer of apparatuses or of products from one closed volume to the other, without at any time the sealing of each of these volumes with respect to the outside being broken, poses a complicated problem to solve. This problem can be solved by a double-door connection device.

Such a double-door device provided with control with multiple securities is for example known from the document FR 2 695 343. Each volume is closed by a door mounted in a flange. Each door is rigidly connected to its flange either by a bayonet link, or by a hinge and a locking system and the two flanges are intended to be rigidly connected to one another by a bayonet link.

For example one of the closed volumes is formed by an isolator and the other volume is formed by a rigid container.

Conventionally the connection part carried by the isolator is designated as the alpha part and the connection part carried by the container is designated as the beta part. The container includes a rigid receptacle having a tubular shape and the beta part. The beta flange is fastened onto the receptacle.

Joints are provided on the alpha part and on the beta part to ensure the sealing between the connected volumes.

The connection between the transfer container and the chamber is carried out by mechanical cooperation of the beta flange and of the alpha flange, for example by a link of the bayonet type. This mechanical cooperation with joints ensures the sealing of the connection.

The connection between the container and the chamber, and more particularly between the beta part and the alpha part, involves moving closer together the beta part and the alpha part so as to make the lugs of the beta flange penetrate into the notches of the alpha flange, then a rotation of the beta flange with respect to the alpha flange to rigidly connect the two flanges and then unlock the alpha and beta doors. The rotation of the beta part is obtained by pivoting the container about its axis, the beta flange being rigidly fastened to the receptacle.

When the container is loaded, a significant mass must be rotated, which can be problematic according to the diameter of the container and the friction between the beta flange and the alpha flange. Moreover, the objects placed in the container also rotate. For example in the case of filled open flasks, the latter will spill.

There are containers "with a rotating flange", in which the beta flange is mounted free in rotation with respect to the receptacle. Thus, to ensure the connection of the alpha part and of the beta part, only the beta flange is rotated and not the beta flange and receptacle assembly. The receptacle thus being immobile, the objects contained in the receptacle do not move during the connection phase.

However, these containers are specific, a user must therefore replace all or a part of their conventional containers by containers with a rotating flange, which can involve a high cost, especially because the rotating flange mechanism is relatively technical.

DISCLOSURE OF THE INVENTION

It is therefore a goal of the present invention to provide a solution relatively simple to implement and having a reduced production cost, allowing a sealed connection between a container and a chamber and not requiring the rotation of the receptacle.

The goal stated above is reached by a rotating interface having the functionalities of connection to a sealed transfer device, and configured to be mounted mobile in rotation on the beta flange of a sealed transfer container.

Thus the user installs this interface on a conventional container and transforms it into a container with a rotating flange in a simple and relatively economical manner with respect to the containers with a rotating flange of the prior art. They can therefore for example temporarily convert a container with a fixed flange into a container with a rotating flange according to the objects that it is intended to contain. Indeed, if these are open flasks filled with liquid, they mount the interface on the beta flange of the container. If these are plugs that are not sensitive to rotation, they use the container without the interface. They can also carry out this adaptation according to the mass of the contents, in order to avoid having to pivot the container if the latter is too heavily loaded.

The end of the interface intended to cooperate with the alpha flange of the chamber is identical to a container beta flange, it is in particular configured to be plugged by the beta door and to rigidly connect in a sealed manner to the alpha flange. As for the end of the interface intended to be mounted on the beta flange, it includes means ensuring an axial rigid connection of the beta flange and of the interface and a free rotation of the beta interface with respect to the beta flange.

In other words, the inventor thought of creating a removable adapter for converting a container with a fixed flange into a container with a rotating flange according to the needs.

The conversion is very fast and very simple to carry out.

The object of the present application is therefore a connection interface rotating about a longitudinal axis (X1), intended to be mounted on a sealed transfer container, said container including a receptacle, a container flange fastened onto the receptacle, the container flange comprising first lugs extending radially towards the outside and which are arranged to form a first bayonet link, the container flange also includes a central passage defined by a lateral wall provided with notches 18 extending radially towards the inside and intended to form a second bayonet link, said longitudinal-axis interface including:

- a first end portion that includes second lugs 25 extending radially towards the outside to form a third bayonet link, a second end portion configured to be connected in a sealed manner with the container flange while forming the first bayonet link, and with a possibility of rotation of the interface with respect to the container flange about the axis of the container flange, a central passage passing all the way through connecting the first end portion and the second end portion, said central passage being configured to be plugged by the container door, a joint mounted on the first end portion and intended to ensure a sealed contact with the sealed transfer device and the container door.

For example, the second end portion includes an annular housing for receiving the end of the container flange, said annular housing including an axial groove opening into an end face of the second end portion, and a radial groove surrounding the axial groove, said radial groove being configured to house the lugs of the container flange and allow a movement of the lugs in rotation in the radial groove about the longitudinal axis in order to form the first bayonet link.

Advantageously, the axial groove includes a radially outer face provided with notches extending axially and opening into the radial groove, said notches being configured for the passage of the lugs of the container flange, and extending radially towards the outside, said interface also including removable stops filling said notches.

In an exemplary embodiment, the axial groove is defined radially towards the inside by a wall bordering the central passage, said axial groove being configured so that once mounted on the container flange, the joint of the container flange is in sealed contact with the inner face of said wall and the bottom of the axial groove.

In another exemplary embodiment, the axial groove is defined radially towards the inside by a wall bordering the central passage, and the interface includes at least a first joint in the bottom of the groove and/or a second joint in the wall so that, once the connection interface has been mounted on the container flange, the joint of the container flange is in sealed contact with the first joint and/or the second joint.

Advantageously, the rotary connection interface includes means facilitating the movement in rotation of the interface with respect to the container flange. The means facilitating the movement in rotation can include rollers or bearings and/or a coating reducing the friction.

Another object of the present application is a sealed transfer container intended to cooperate with the interface according to the invention, including a receptacle provided with a bottom and with an open end, a container flange including an end fastened to the open end of the receptacle and an end intended to mechanically cooperate with a sealed transfer device, a container door plugging the container flange, said container flange including lugs extending radially towards the outside and intended to cooperate with the sealed transfer device by a bayonet link, one or more of said lugs including rollers mounted on axes extending radially and configured to roll in the radial groove, said end also including a joint intended to ensure a sealed contact with the sealed transfer device and with the container door.

For example, the lugs each include at least one window in which one or more rollers are mounted.

In an exemplary embodiment, the joint of the container flange and the joint of the rotary connection interface are identical. Another object of the present application is a method for converting a transfer container with a fixed flange into a container with a rotating flange:

providing a container with a fixed flange, providing a rotary connection interface according to the invention, removing the container door from the container flange, installing the container door on the rotary connection interface, mounting the rotary connection interface on the container flange so that the joint of the container flange bears against the rotary connection interface, axially immobilising the rotary connection interface on the container flange.

The conversion method can include:

the alignment of the lugs of the container flange with the notches of the rotary connection interface, the insertion of the lugs of the container flange into the notches until the lugs arrive in the radial groove, rotating the rotary connection interface with respect to the container flange, installing the stops in each of the notches, fastening the stops onto the rotary connection interface.

The invention also relates to a connection interface rotating about a longitudinal axis including:

a first end portion that includes outer lugs extending radially towards the outside and which are arranged to form an outer upper bayonet link, a second end portion that includes lower notches arranged to form a peripheral lower bayonet link with an outer element, the second end portion being arranged to allow a rotation of the interface about the longitudinal axis after establishment of the bayonet link while maintaining the lower bayonet link, a central passage passing all the way through connecting the first end portion and the second end portion, said central passage being configured to form an inner upper bayonet link, a joint mounted on the first end portion.

Advantageously, the second end portion includes an annular housing that includes an axial groove opening into an end face of the second end portion, and a radial groove surrounding the axial groove, said radial groove being configured to house lugs of the outer element in order to form the peripheral lower bayonet link and allow a movement of the lugs in rotation in the radial groove about the longitudinal axis.

Preferably, the axial groove includes a radially outer face provided with notches extending axially and opening into the radial groove, said notches being configured for the passage of the lugs of the container flange, and extending radially towards the outside, said interface also including removable stops filling said notches.

Optionally, the axial groove is defined radially towards the inside by a wall bordering the central passage, said axial groove being configured so that once the peripheral lower bayonet link has been established with the outer element, the inner face of said wall and the bottom of the axial groove are in sealed contact with a joint of the outer element.

Also optionally, the axial groove is defined radially towards the inside by a wall bordering the central passage, and wherein the interface includes at least a first joint in the bottom of the groove and/or a second joint in the wall so that, once the peripheral lower bayonet link has been established with the outer element, the first joint and/or the second joint is in sealed contact with a joint of the outer element.

Advantageously, the connection interface includes means facilitating the movement in rotation of the interface with respect to the outer element.

Advantageously, the means facilitating the movement in rotation include rollers or bearings and/or a coating reducing the friction.

The invention also relates to a method for converting a transfer container with a fixed flange into a container with a rotating flange:

providing a container including a container flange and a container door removably mounted in the container flange by a bayonet link, the container flange also comprises a joint mounted on the container flange, providing a rotary connection interface described above, removing the container door from the container flange, installing the container door on the rotary connection interface while forming the inner upper bayonet link, mounting the rotary connection interface on the container flange so that the joint of the container flange bears against the rotary connection interface, axially immobilising the rotary connection interface on the container flange.

BRIEF DESCRIPTION OF THE DRAWINGS

The present invention will be better understood on the basis of the following description and the appended drawings in which.

DETAILED DISCLOSURE OF SPECIFIC EMBODIMENTS

Figure 1:
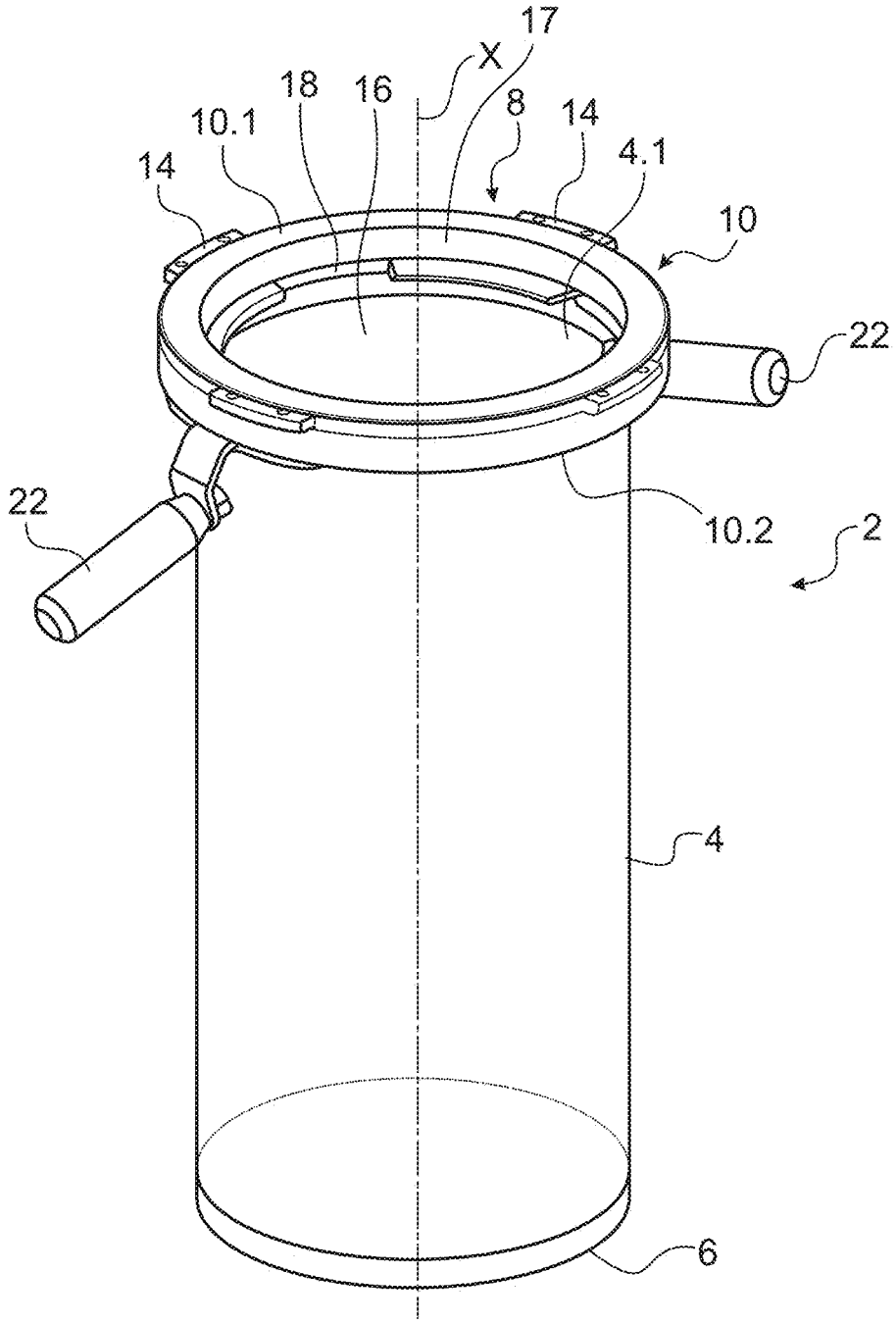
FIG. 1 is a perspective view of a sealed transfer container to which the invention can apply.
Figure 2:
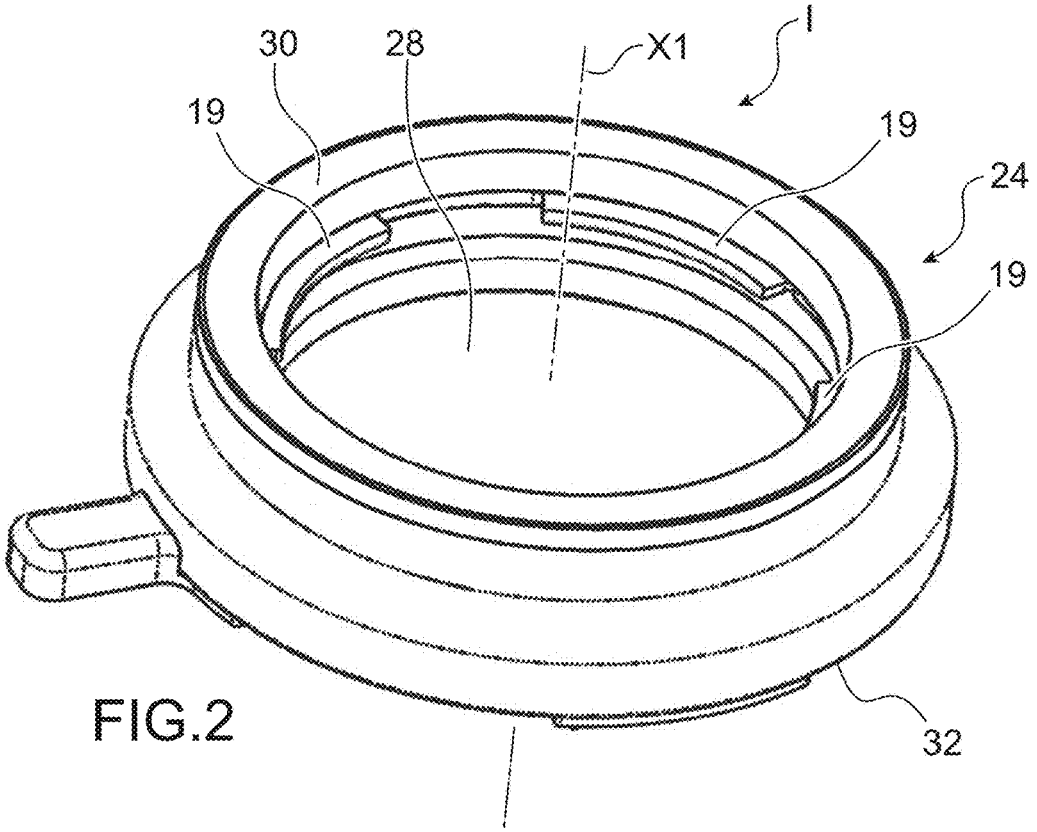
FIG. 2 is a perspective view of an exemplary embodiment of the rotary connection interface shown alone.

FIG. 1 shows a container on which the rotary connection interface can be mounted to convert it at least temporarily into a container with a rotating flange.

The container 2 includes a rigid receptacle 4 having a cylindrical shape of revolution having an axis X provided with a longitudinal end closed by a bottom 6 and with an open longitudinal end 4.1 onto which a beta part 8 is fastened.

Figure 3:
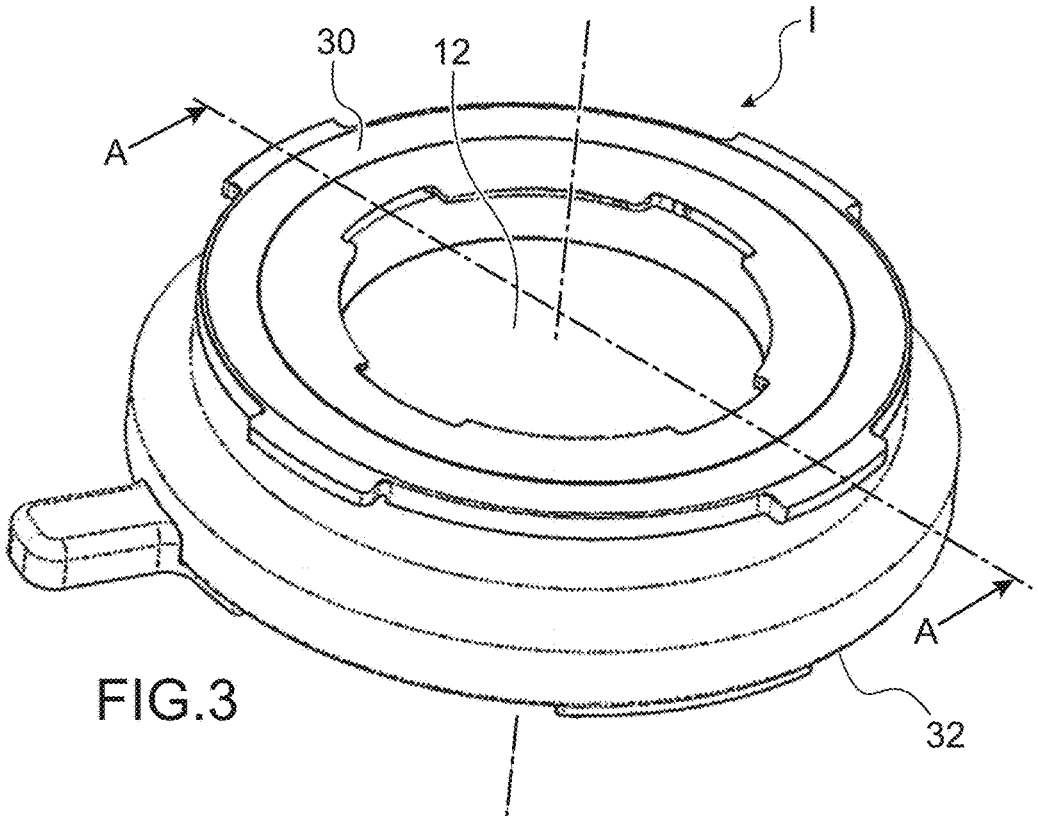
FIG. 3 is a perspective view of the interface of FIG. 2 plugged by a beta door.

The beta part 8 includes a beta flange or container flange 10 having an axis X and a beta door or container door 12 (visible in FIG. 3 mounted on the interface I described below). The beta part 8 is intended to cooperate by bayonet links with an alpha part (not shown) mounted on a wall of a sealed chamber including an alpha flange or cell flange plugged by an alpha door or cell door. The alpha part will be designated "sealed connection device".

An example of a sealed connection device implementing bayonet links is for example described in the document FR 2 695 343.

The container flange 10 includes a first longitudinal end 10.1 intended to cooperate with the alpha flange and with the container door 12 and a second longitudinal end 10.2 fastened onto the open end of the rigid receptacle 4.1, for example by welding or by screwing.

The first end 10.1 of the container flange includes first lugs 14 extending radially towards the outside and intended to cooperate with notches of the cell flange to form a first bayonet link between the container flange and the cell flange. The first bayonet link is also called peripheral lower bayonet link.

The container flange 10 includes a central passage 16 intended to be plugged by the container door 12. The container door 12 is rigidly connected to the container flange 10 by a second bayonet link, also called inner upper bayonet link. The central passage 16 is defined by a lateral wall 17 provided with notches 18 extending radially towards the inside of the central passage 16 and which are intended to receive lugs of the container door 12. Finally, the container door 12 is configured to be rigidly connected to the cell door by a fourth bayonet link.

Figure 4A:
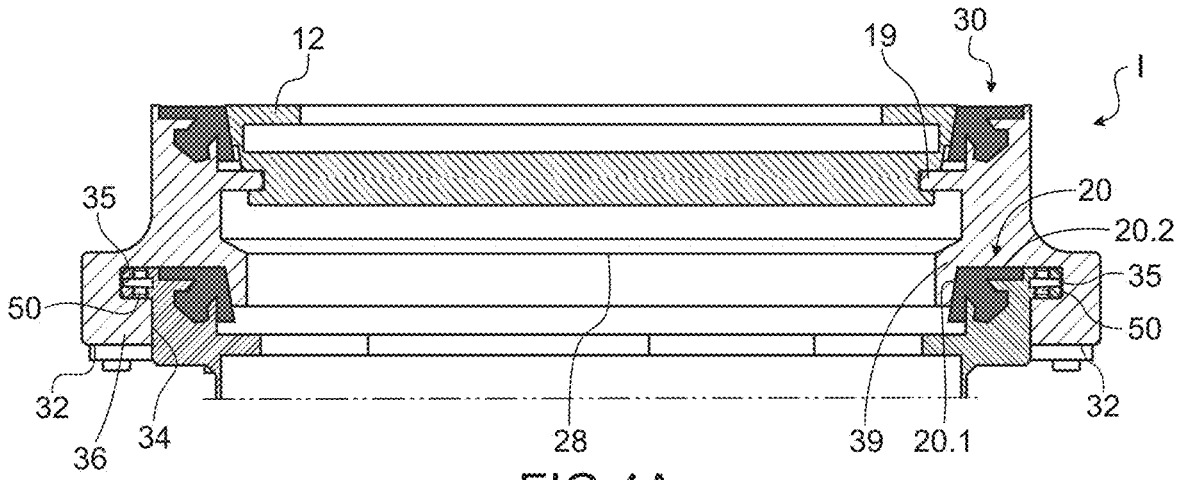
FIG. 4A is a longitudinal cross-sectional view of the interface of FIG. 3 according to a cutting plane A-A.

The container flange 10 also includes an annular joint 20 (FIGS. 4A and 4B) comprising a radially inner face 20.1 defining the central passage downstream of the notches 18 in the direction of movement of the beta flange closer to the alpha flange, this joint ensuring the sealing with the container door 12. The joint 20 also includes an end face 20.2 intended to come in contact with the alpha flange and to ensure the sealed contact between the alpha flange and the beta flange. The lugs 14 extend radially towards the outside with respect to the joint 20.

In the example shown, the container 2 also includes handles 22 extending radially towards the outside and intended to allow the rotation of the container about the longitudinal axis X for its connection to the alpha part of the cell. The handles can be removable.

FIGS. 2 to 5 show an exemplary embodiment of a rotary connection interface I intended to at least temporarily be provided on the container 2 and to transform it into a container with a rotating flange.

The interface I is intended to carry out the function of the container flange 10 which is on the one hand to ensure the sealed mounting of the container door 12 in order to close the container in a sealed manner, and on the other hand to ensure the sealed connection of the container to an alpha part mounted in a wall of a chamber.

The interface includes a first longitudinal end portion 24 intended to cooperate with the alpha part and a second longitudinal end portion 26 intended to cooperate with the beta flange.

The first end portion 24 of the interface has a shape identical to that of the first end 10.1 of the beta flange; the first end portion 24 also has dimensions identical to those of the first end 10.1 of the beta flange. It includes second lugs 25 extending radially towards the outside to cooperate with the notches of the alpha flange, a central passage 28 bordered by a joint 30; the joint ensures both the sealing with the beta door and with the alpha flange. The joint 30 is identical or similar to the joint 20.

The dimensions of the central passage 28 of the interface I are such that the container door 12 can be mounted on the interface I and ensure its sealed closing. Thus, when the interface is mounted on the beta flange 10 fastened onto the receptacle, the container door 12 is used to close the central passage 28 of the interface. For this purpose, and as visible in FIG. 4A, the central passage 28 comprises third inner lugs 19 protruding radially towards the inside to cooperate with the door 12 and reproduce the inner upper bayonet link.

The second end portion 26 of the interface I is configured to be connected to the first end 10.1 of the beta flange. The connection between the interface I and the beta flange is such that it ensures an axial rigid connection of the interface I and of the beta flange, a mobility in rotation of the interface I with respect to the beta flange about the longitudinal axis X and a sealing between the interface and the beta flange.

The second end portion 26 has an outer diameter greater than that of the first end portion and forms a housing for the beta flange. The second end portion 26 forms a base for connection to the container.

The second end portion 26 of the interface includes an axial groove 34 to house the beta flange 10. The second end portion 26 also includes an end face 32 perpendicular to the longitudinal axis X1 of the interface into which the axial groove 34 opens.

The second end portion 26 also includes a radial groove 35 formed in the radially outer lateral wall 36, defining the axial groove 34, and opening into the axial groove 34. The radially outer wall 36 includes notches 38 extending axially from the end face 32 to the radial groove 35 and distributed angularly around the axis X1. There are as many notches 38 as the beta flange 10 has lugs. The notches 38 are dimensioned and disposed angularly to allow the axial passage of the lugs of the beta flange.

The second end portion also includes a radially inner wall 39 bordering the inside of the axial groove 34 and the outside of the passage 28.

The radial groove 35 includes two annular lateral faces 35.1, 35.2 perpendicular to the axis X1 and a cylindrical bottom 35.3 having the axis X1.

Figure 4B:
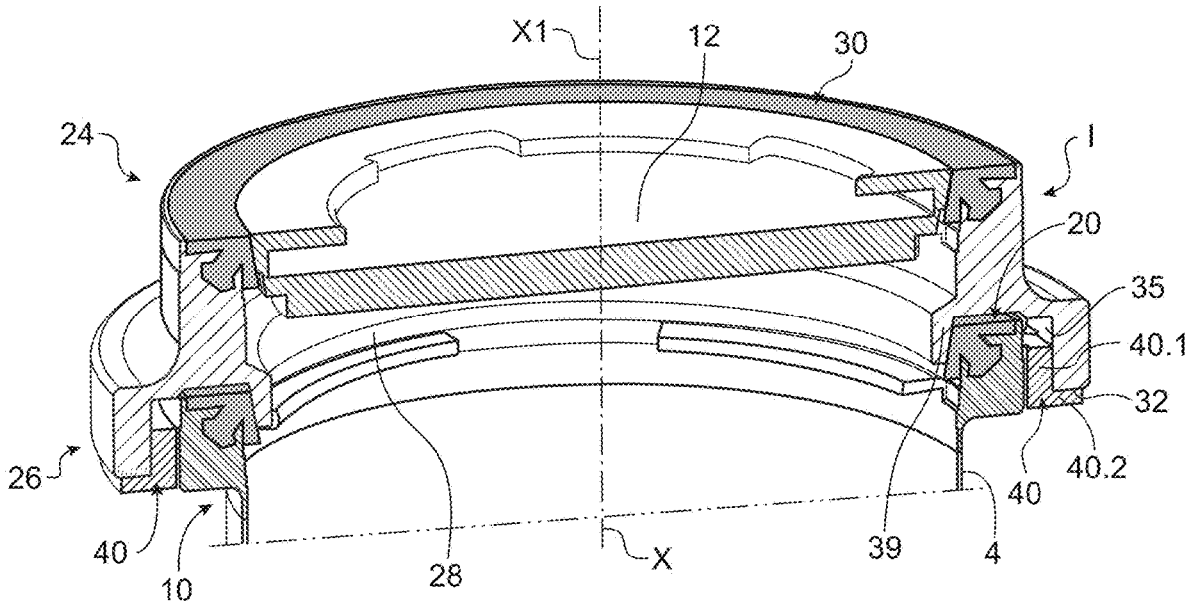
FIG. 4B is a longitudinal cross-sectional view of the interface of FIG. 3 according to a cutting plane A-A.
Figure 5:
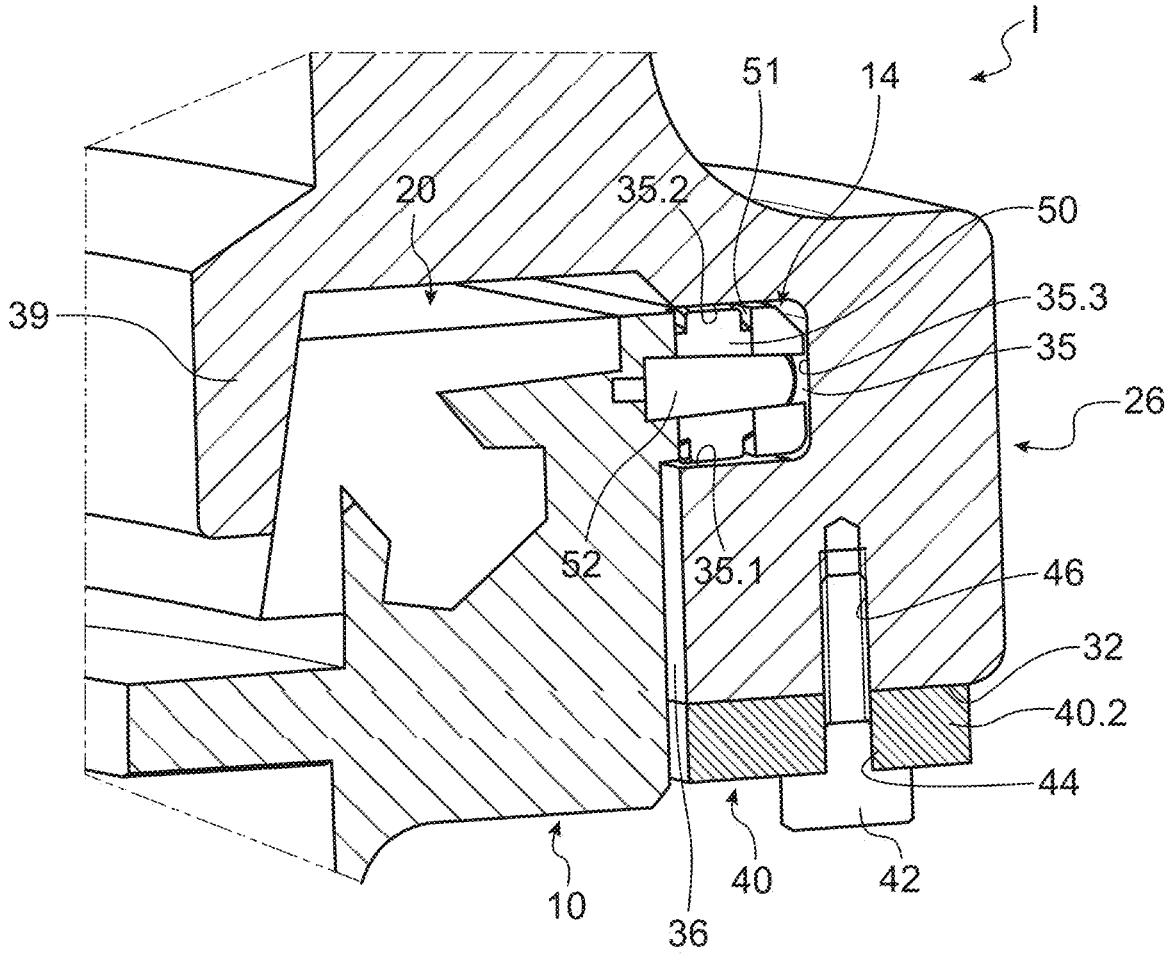
FIG. 5 is a detail view of FIG. 4A.

The interface also includes stops 40 configured to fill in the notches 38 and define a continuous lateral surface 35.1 of the groove 35, as visible in FIG. 4B. The stops are fastened onto the interface for example by screws 42. The stops include a body 40.1 configured to penetrate into a notch 38 and a fastening shoulder 40.2 surrounding the body 40.1. The fastening shoulder includes holes 44, two in the example shown, aligning with holes 46 made in the end face 32, on either side of each notch 38. The screws 42 pass through the holes 44 and are screwed into the holes 46.

The interface according to the invention is adapted to cooperate with flanges of existing containers without requiring modifications to the latter.

Alternatively, there can be means between the lugs of the beta flange and the radial groove 35 of the interface to reduce the friction and facilitate their relative rotation, means of particular interest in a use in containers with a large diameter made of stainless steel.

In the example shown, the container includes such means designated as 48. The means 48 include rollers 50 mounted on the lugs of the beta flange intended to roll on the lateral faces 35.1, 35.2 in the radial groove 35. In this example, each roller 50 is housed in a window 51 formed in a lug 14. Each roller 50 is mounted on an axis 52 extending radially in a window. In the example shown, each lug 14 includes two windows each provided with a roller 50. Alternatively, one roller or more than two rollers per lug are possible. Moreover, more than one roller can be disposed in a lug. Preferably, all the lugs include one or more rollers to ensure balanced mounting.

Means other than rollers can be implemented, for example ball bearings or roller bearings or pads.

Alternatively, the rollers or any other means are present in the radial groove 35 of the interface reducing the friction.

Alternatively to the rollers or other bearings or in addition to the latter, the radial groove and/or the lugs of the container flange include a treatment reducing the friction between the interface and the flange, for example this is a coating made of polytetrafluoroethylene (PTFE) of the Teflon® type or a ceramic coating, a diamond-like carbon (DLC) treatment, or a surface state obtained by mechanical or electrochemical polishing, allowing to reduce the friction between the interface and the flange.

The presence of these rollers inside the lugs of the beta flange does not prevent the direct connection of the flange onto a conventional alpha flange.

The two lateral faces 35.1, 35.2 of the radial groove 35 thus form rolling tracks for the rollers. The filling of the notches by the stops ensures a continuous and flat surface as visible in FIG. 4B.

Very advantageously, the sealing between the beta flange 10 and the interface I is ensured by the annular joint 20 carried by the beta flange 10, the end face 20.2 of which bears against the bottom of the axial groove 34, and/or its radially inner edge 20.1 bears against the outer face of the wall 39. The sealing is thus created very easily and does not require the implementation of an additional joint.

Figure 8:
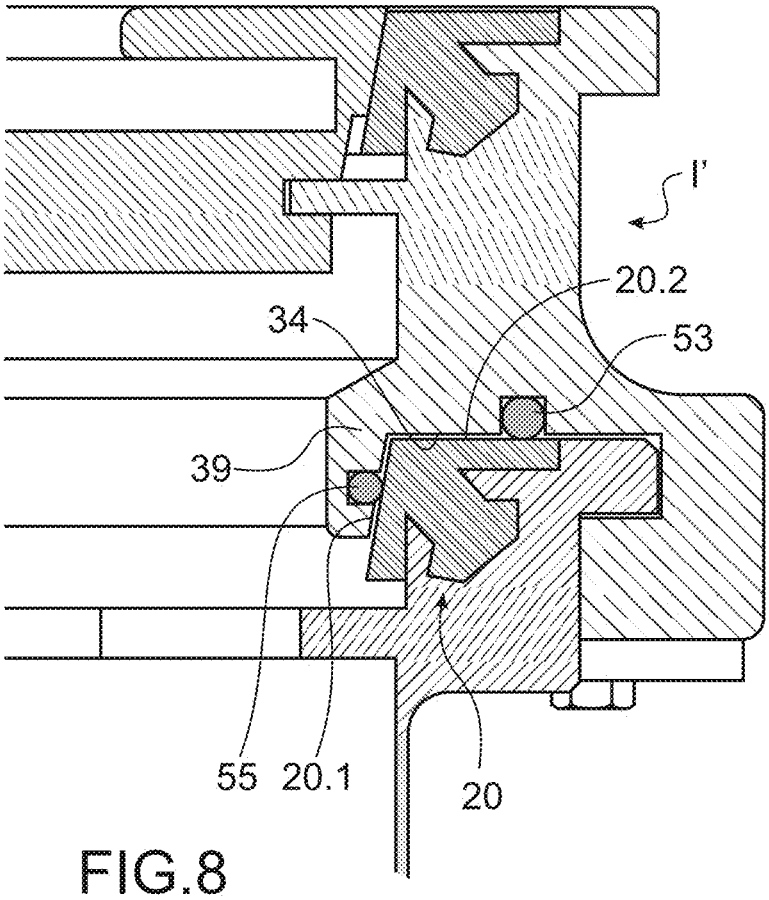
FIG. 8 is a partial longitudinal cross-sectional view of an interface according to another exemplary embodiment.

FIG. 8 shows another example of an interface mounted on the container flange; there is a clearance between the bottom of the axial groove 34 and the face 20.2 of the joint of the beta flange and there is a clearance between the outer face of the wall 39 and the face 20.1 of the joint of the beta flange. A joint 53 is provided at the bottom of the groove 34 and a joint 55 is provided in the wall 39. The joints 53, 55 can be O-rings or rectangular joints. The joints 53, 55 come in contact with the faces 20.2 and 20.1 of the annular joint 20. This example has the advantage of reducing the friction since the surfaces in contact are reduced. According to one alternative, the face 20.2 of the joint is in contact with the bottom of the groove and a joint 55 is provided in the wall 39. Inversely, the face 20.1 of the joint 20 is in contact with the face of the wall 39 and a joint 53 is provided in the groove 34.

Figure 6A:
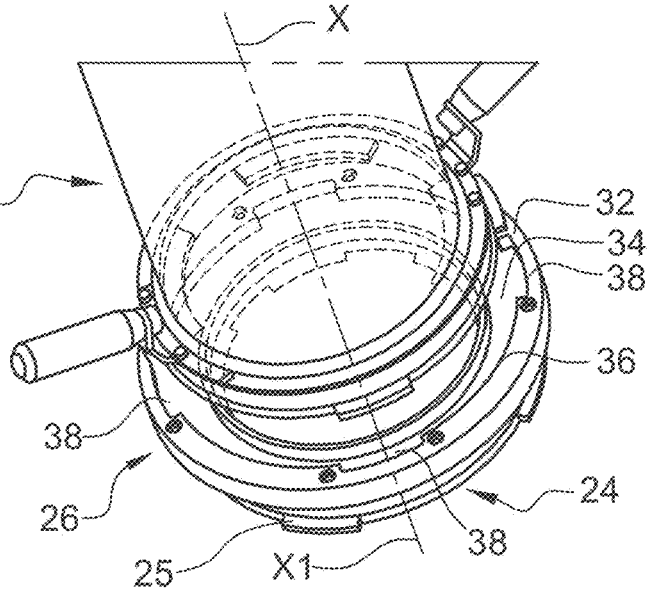
FIG. 6A.
Figure 6B:
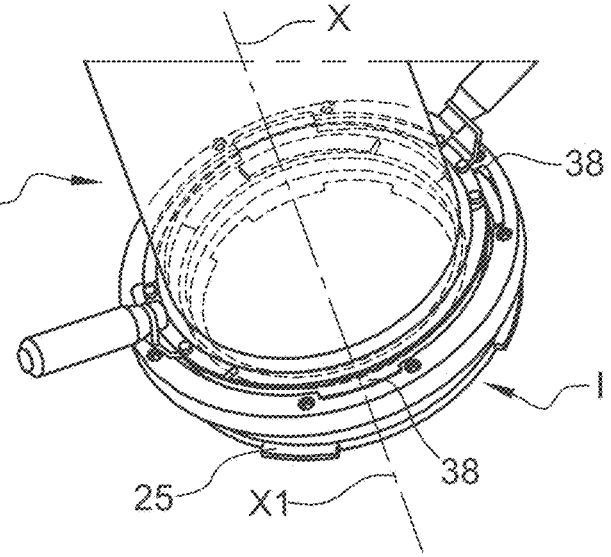
FIG. 6B.
Figure 6C:
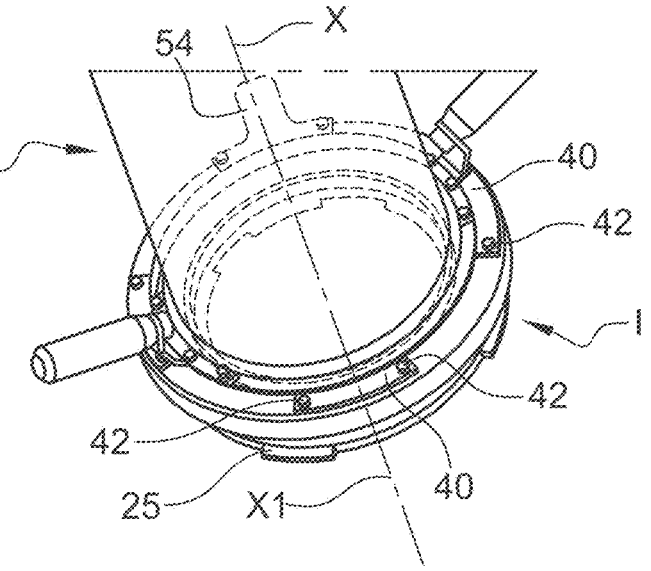
FIG. 6C show various steps of mounting the interface of FIG. 2 on the container of FIG. 1.

The interface preferably includes one or more handles 54 for pivoting the interface with respect to the container. The handle(s) extend(s) for example radially with respect to the second end portion 26. In the example shown, the handle 54 is carried by a stop 40 and is extended radially towards the outside from the shoulder 40.2 of the stop 40 (FIG. 6C).

The conversion of a container with a fixed flange into a container with a rotating flange will now be described.

The door 12 is removed from the beta flange and is fastened onto the interface.

The second end portion 26 of the interface I is oriented towards the beta flange 10 and the interface I is moved axially closer to the beta flange while aligning the axes X and X1. The interface I is oriented angularly so that each radial notch 38 is aligned with a lug 14 of the beta flange (FIG. 6A).

The interface I is moved close enough that the lugs penetrate into the radial notches and bear against the bottom of the axial groove 34. The interface is rotated about the axis X1 by several degrees to engage the lugs of the beta flange in the radial groove 35 (FIG. 6B).

The stops 40 are then installed. The body 40.1 of a stop 40 is inserted into a notch 38 and the fastening shoulder 40.2 bears against the face 32 around the notch. Screws 42 are inserted into the holes 44 and screwed into the holes 46 to rigidly connect the stops 40 to the interface I. The inner lateral surface 35.1 is thus continuous; the rollers can thus roll on the latter (FIG. 6C).

As a result, the interface is axially rigidly connected to the container while being free to pivot about the longitudinal axis X1 which is the same as the longitudinal axis X of the container. Moreover, the assembly thus created is sealed.

Figure 7:
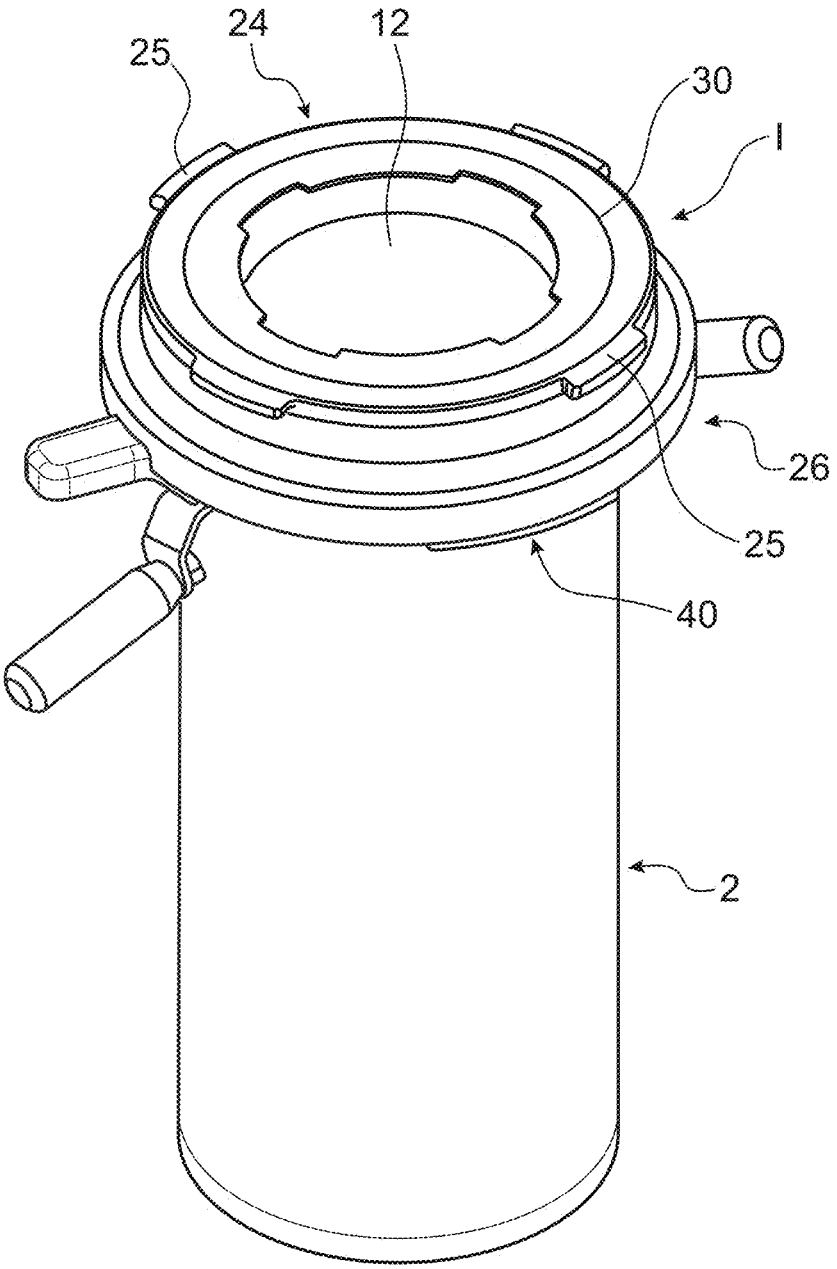
FIG. 7 is a perspective view of the container of FIG. 1 equipped with the interface of FIG. 3.

A container with a fixed flange has thus been converted into a container with a rotating flange (FIG. 7).

It should be noted that the installation of the interface on the container involves the removal of the container door from the container flange, which has the effect of breaking the confinement in the container. After installation of the interface plugged by the container door, a step of sterilisation of the inside of the container takes place in the absence or in the presence of the objects to be transferred.

The connection of this container to an alpha part of a chamber with a view to a sealed transfer is carried out in the same manner as a container with a rotating flange of the prior art.

For example, the lugs of the interface are mounted in the notches of the alpha flange. Then only the interface I is pivoted about the longitudinal axis X ensuring the rigid connection of the interface onto the alpha flange, the rigid connection of the beta door and of the alpha door and finally the unlocking of the doors with respect to the flanges.

Since the container has not pivoted, the objects that it contains are not knocked over. It is thus possible to transfer fragile objects and/or filled open receptacles.

It should be noted that the rotation between the interface and the beta flange is at most 60° in the clockwise direction and in the anti-clockwise direction and only for the connection to the chamber and the disconnection from the chamber. This stress is similar to that that the joint 20 undergoes during the direct connection of the beta flange onto the alpha part. Consequently, the implementation of a rotating interface does not risk prematurely wearing down the joint and reducing the service life of the container.

The interface can be made from the same material as the beta flange. Alternatively, the interface is made of stainless steel, of plastic material, for example of polyethylene, of PTFE, of PEEK, of polycarbonate, of PSU.

Via the invention, it is possible to easily and quickly convert a sealed transfer container with a fixed flange into a container with a rotating flange according to the needs. This conversion does not require any additional aptitude since it implements a link of the bayonet type to rigidly connect the interface to the container, the manipulation of which is already mastered for the connection of the containers with a fixed flange. Moreover, the manufacturing of the interface is relatively simple since it is structurally very close to the manufacturing of a container flange.

What is claimed is:

1. A rotary connection interface configured to rotate about a longitudinal axis, the rotary connection interface including:

a first end portion that includes outer lugs extending radially outwards and which are configured to form an outer upper bayonet link, a second end portion which includes lower notches configured to form a peripheral lower bayonet link with an outer element, the second end portion being arranged to allow a rotation of the rotary connection interface about the longitudinal axis after establishment of the upper bayonet link while maintaining the lower bayonet link, a central passage configured to pass through and connect the first end portion and the second end portion, said central passage comprising inner lugs configured to form an inner upper bayonet link, a joint mounted on the first end portion, wherein the second end portion includes an annular housing that includes an axial groove opening into an end face of the second end portion, and a radial groove surrounding the axial groove, said radial groove being configured to house lugs of the outer element in order to form the peripheral lower bayonet link and allow a movement of the lugs in rotation in the radial groove about the longitudinal axis in order to allow a rotation of the interface about the longitudinal axis while maintaining the peripheral lower bayonet link.

2. The rotary connection interface according to claim 1, wherein the axial groove includes a radially outer face provided with notches extending axially and opening into the radial groove, said notches being configured for the passage of the lugs of the outer element, and extending radially outwards, said interface also including removable stops filling said notches.

3. The rotary connection interface according to claim 1, wherein the axial groove is defined radially inwards by a wall bordering the central passage, said axial groove being configured so that once the peripheral lower bayonet link has been established with the outer element, the inner face of said wall and a bottom of the axial groove are in sealed contact with a joint of the outer element.

4. The rotary connection interface according to claim 1, wherein the axial groove is defined radially inwards by a wall bordering the central passage, and wherein the interface includes at least a first joint in a bottom of the groove and/or a second joint in the wall so that, once the peripheral lower bayonet link has been established with the outer element, the first joint and/or the second joint is in sealed contact with a joint of the outer element.

5. The rotary connection interface according to claim 1, including rollers, bearings, and/or a coating configured to facilitate the movement in rotation of the interface with respect to the outer element.

6. The rotary connection interface according to claim 5, wherein the coating is configured to reduce friction.

7. A method for converting a transfer container with a fixed flange into a container with a rotating flange:

providing a container including a container flange and a container door removably mounted in the container flange by a bayonet link, the container flange also comprises a joint mounted on the container flange, providing a rotary connection interface configured to rotate about a longitudinal axis, the rotary connection interface including:

a first end portion that includes outer lugs extending radially outwards and which are configured to form an outer upper bayonet link, a second end portion which includes lower notches configured to form a peripheral lower bayonet link with an outer element, the second end portion being arranged to allow a rotation of the rotary connection interface about the longitudinal axis after establishment of the upper bayonet link while maintaining the lower bayonet link, a central passage configured to pass through and connect the first end portion and the second end portion, said central passage comprising inner lugs configured to form an inner upper bayonet link, and a joint mounted on the first end portion, wherein the second end portion includes an annular housing that includes an axial groove opening into an end face of the second end portion, and a radial groove surrounding the axial groove, said radial groove being configured to house lugs of the outer element in order to form the peripheral lower bayonet link and allow a movement of the lugs in rotation in the radial groove about the longitudinal axis in order to allow a rotation of the interface about the longitudinal axis while maintaining the peripheral lower bayonet link, removing the container door from the container flange, installing the container door on the rotary connection interface while forming the inner upper bayonet link, mounting the rotary connection interface on the container flange while forming the peripheral lower bayonet link so that the joint of the container flange bears against the rotary connection interface, axially immobilising the rotary connection interface on the container flange.

8. The method according to claim 7, wherein the axial groove includes a radially outer face provided with notches extending axially and opening into the radial groove, said notches being configured for the passage of the lugs of the outer element, and extending radially outwards, said interface also including removable stops filling said notches, the method further including:

the alignment of the lugs of the container flange with the notches of the rotary connection interface, the insertion of the lugs of the container flange into the notches until the lugs arrive in the radial groove, rotating the rotary connection interface with respect to the container flange, installing stops in each of the notches, fastening the stops onto the rotary connection interface.

* * * * *